United States Patent [19]

Wickberg

[11] Patent Number: 5,040,927

[45] Date of Patent: Aug. 20, 1991

[54] PRESSURE DRIVER FOR PILINGS

[76] Inventor: Norman E. Wickberg, 27 Wardell Cir., Oceanport, N.J. 07757

[21] Appl. No.: 513,756

[22] Filed: May 29, 1990

[51] Int. Cl.[5] ..... E02D 7/20

[52] U.S. Cl. ..... 405/232; 173/23; 173/44

[58] Field of Search ..... 405/228, 232; 173/22, 173/23, 27, 39, 44

[56] References Cited

U.S. PATENT DOCUMENTS

| | | | |
|---|---|---|---|
| 2,476,390 | 7/1949 | Simmons | 173/43 |
| 3,783,953 | 1/1974 | Kopaska | 173/23 |
| 3,833,072 | 9/1974 | Back | 405/232 X |
| 3,861,156 | 1/1975 | Uchida | 405/232 |
| 4,050,526 | 9/1977 | Delke | 173/27 |
| 4,075,858 | 2/1978 | Frederick | 405/228 |
| 4,102,147 | 7/1978 | Jansz | 405/228 |
| 4,195,698 | 4/1980 | Nakagawasai | 173/44 |
| 4,280,772 | 7/1981 | Rusche | 405/232 |
| 4,697,959 | 10/1987 | Kinnan | 405/232 |
| 4,755,080 | 7/1988 | Cortlever et al. | 405/232 X |

FOREIGN PATENT DOCUMENTS 2189533 10/1987 United Kingdom .

*Primary Examiner*—David H. Corbin

*Attorney, Agent, or Firm*—Charles Lee Thomason

[57] ABSTRACT

Apparatus that mounts on a standard construction vehicle, such as a crawler or a backhoe. The apparatus drives piles, including sheet piles, that typically are used for bulkheading and earth fortification. A hydraulic cylinder with a downward extendable piston is fixed on a leader and the hydraulic pressure drives the piles. The apparatus is self-erecting and transportable on the construction vehicle.

8 Claims, 2 Drawing Sheets

PRESSURE DRIVER FOR PILINGS

SPECIFICATION FIELD OF THE INVENTION

The present invention relates to apparatus for driving pilings.

BACKGROUND OF THE INVENTION

Changes in the pilings used for construction and earth work have necessitated improvements in the apparatus used to drive pilings. Cost and safety concerns have made metal and timber pilings less desirable. Consequently, lightweight reinforced concrete piles or polymeric sheet piles will be used more often. Traditional percussion pile drivers would damage these lightweight pilings. Thus, a need exits for an improved driver for pilings. The subject invention uses hydraulics to impose a steady driving pressure upon the piling to drive it into place.

OBJECTS AND SUMMARY OF THE INVENTION

The object of the invention is to provide a driver for pilings that uses continuous hydraulic pressure, instead of percussion or hammer force. The apparatus is self erecting is mounted on a standard crawler vehicle so it is entirely transportable.

DESCRIPTION OF THE PREFERRED EMBODIMENTS

Figure 1:
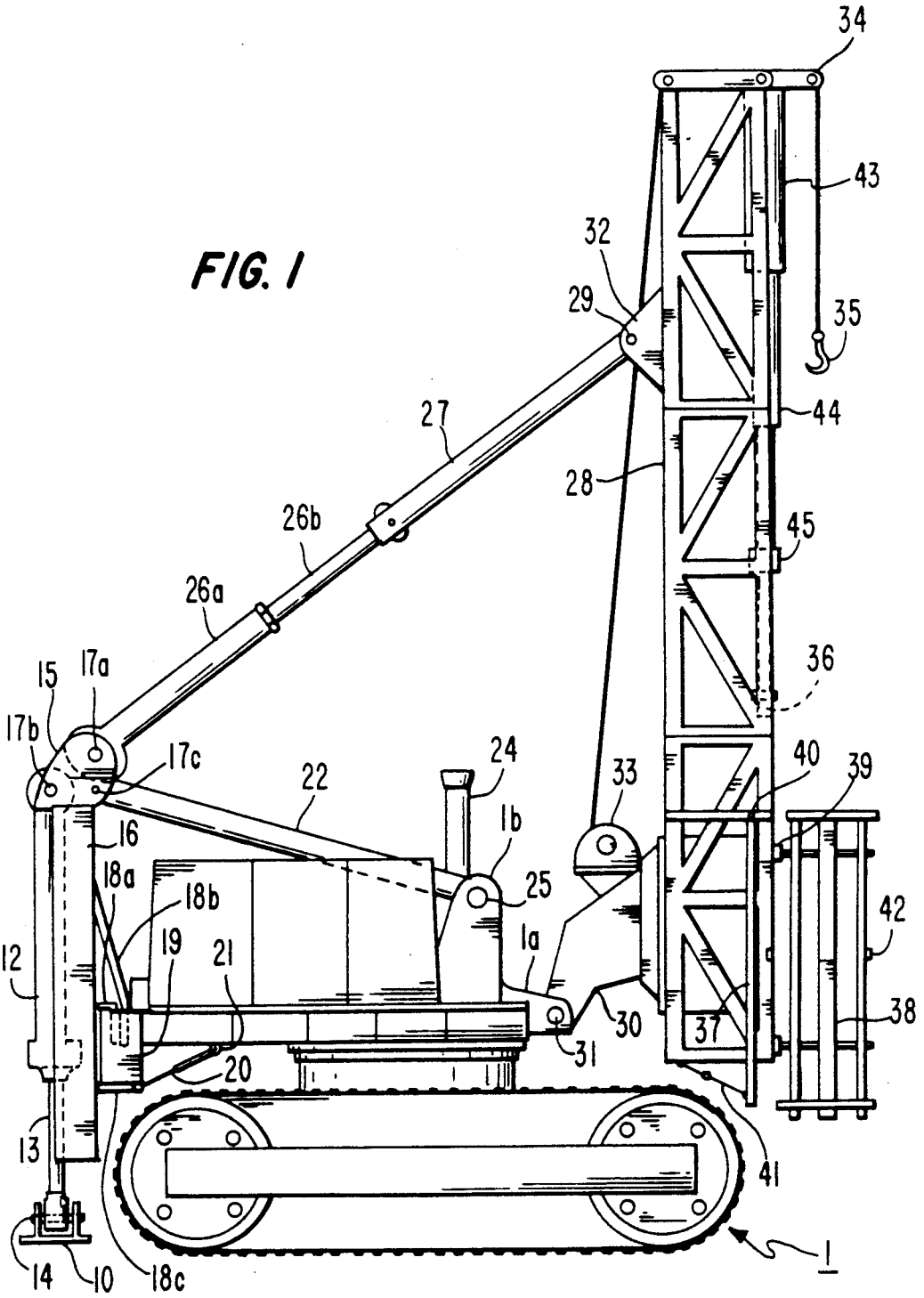
FIG. 1 is a side view of the apparatus mounted on the standard crawler vehicle.
Figure 2:
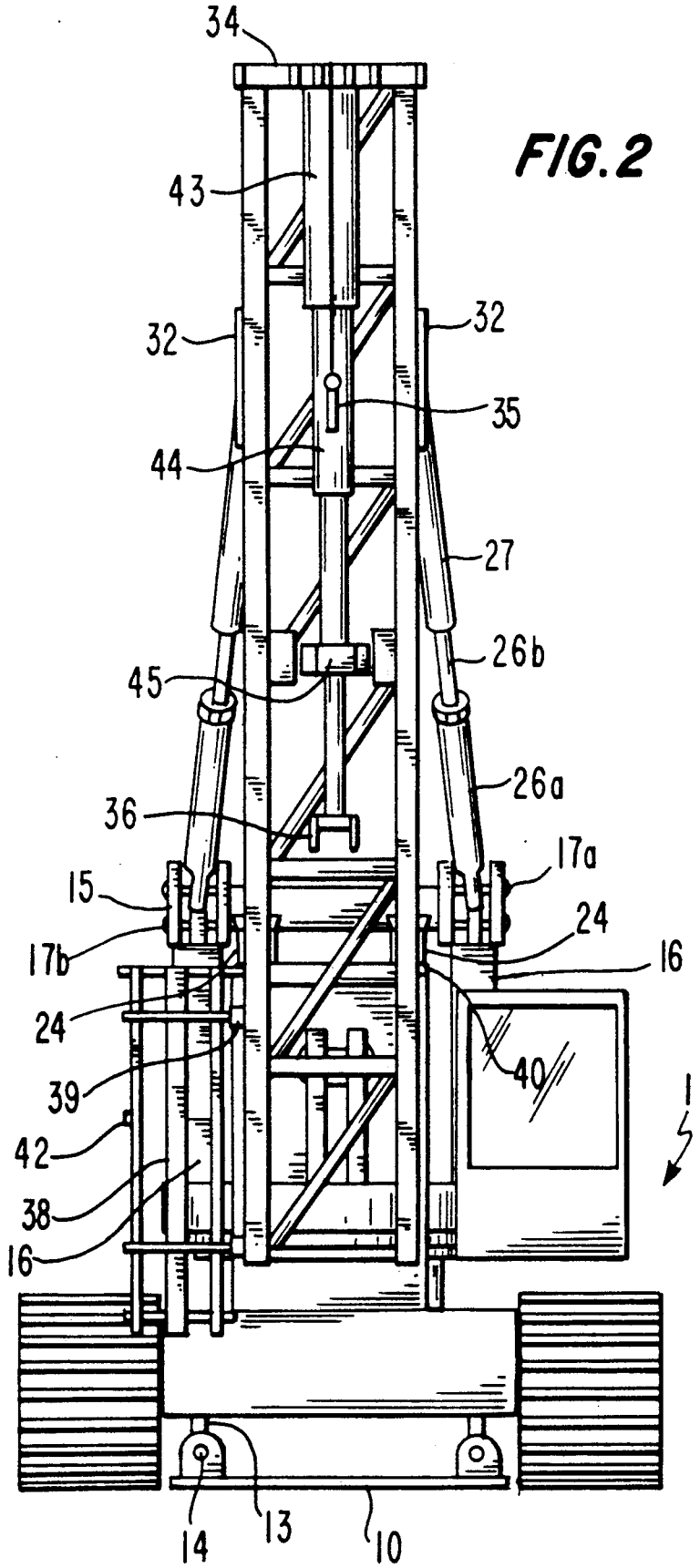
FIG. 2 is a front view of the apparatus.

The driving apparatus attaches to a standard crawler vehicle or back hoe. This standard construction vehicle 1 must be a version equipped with hydraulic pumps and controls and with, attachment points usually called ears 1*a* and 1*b*, and preferably with a counterweight 19. At the rear of the standard crawler, there is a base member 10 attached to positioning means. Said positioning means or stabilizers can be comprised of two hydraulic cylinders 12 with piston ends 13 attached to said base member. Various connecting means can be used, but preferably it is a pin 14 or equivalent which will permit movement at the connecting point. The positioning means can extend and retract to stabilize and level the crawler and driving apparatus. When the base member 10 is pressed against the ground surface, it provides a countering force when the driver is operated. The cylinder in the hydraulic positioning means is connected to uprights 16 that are part 46 of a gantry 22. The gantry is a frame that attaches to the front and rear of the crawler. The rear of the gantry includes the two upright members 16 that have a cross-piece 15 or cross bar joining them at or near the top. Said cross-piece has several attachment point or ears 17. A first set of attachment points 17*b* on the cross-piece are adapted to receive the cylinder end of said hydraulic positioning means. These points may be at the top of 16 or along its length. The upright members include brackets 18 that, at their top 18*a*, slot into the counterweight 19 on the rear of a typical crawler. The bottom of said brackets extends under the counter weight 19, so that in final alignment the bracket resembles a C-shape that extends along not less than two side surfaces of the counterweight 19. The bottom of said bracket 18*c* has an attachment that receives one end of an adjustable connector arm 20. Said arm at the opposite end attaches to a point 21 on the undercarriage of the crawler. This arm adjusts, using a turnbuckle 20 for example, to permit tightening between the attachment 21 on the undercarriage and the lower end of the bracket 18*c*, in order to hold the upright member 16 of the gantry fixed rigidly against the counterweight and the rear of the crawler.

Also at the top of the upright members of the gantry are two transverse compression members 22 that extend forward to attach to ears 1*b* typically included on a standard crawler. In one embodiment, the members 22 extend past ears 1*b* and 1*a* and the members would include ears forward of the attachment point on the crawler. Said traverse members can be adapted with horizontal posts 24 suited for being rest positions for the erecting struts 26 during transport. The traverse members 22 can be unitary with the gantry or detachable using a second set of ears on the crosspiece and suitable means, such as locking pins. Said cross piece further is adapted with a third pair of ears to serve as connection points 17*a*. Attached at these points are the erecting struts 26. Each erecting strut 26 includes a hydraulic cylinder 26*a* and piston 26*b* to which is attached an extension arm 27. At the opposite end, each said extension arms 27 connects to the leader, with a pin or trunnion 29 into flange 32. The leader 28 is a tower structure hereinafter described. The erecting struts or extension arms can be adapted with a cross bar that is attached near the center of the strut and arm length. Such a cross bar can be connected rigidly to keep one erecting strut aligned with the other strut. The erecting struts 26 have the capability to extend and retract using hydraulic power. This capability enables the leader 28 to be raised and positioned vertically. The connecting means 29 for attaching the leader to the extension arms of the erecting struts will allow pivoting.

The leader includes structures that function as lifting means, receiving means, guide means, and driving means. The leader 28 in one embodiment consists of leads formed of a trussed tower or a reinforced column that is raised upright for use. It connects to ears on the vehicle that typically accept accessory equipment like cranes or bucket loader. At the lower end, the leader has a flange 30 that accepts a locking pin 31 or bolt, and in the manner, the flange will fit and attach to ears 1*a* on the front of the construction vehicle or to ears included on the traverse compression members of the gantry 22. Near the upper end, the leader has a flange 32 with attachment points that accept the connecting means for the erecting struts and extension arms previously described. In another embodiment, the leads are comprised of several sectional pieces of trussed tower or equivalent. In this version, the upper flange 32 and the lower flange 30 comprise quadrilateral frames that accept the sections of the tower. The leads would then be comprised of an upper section attached to and above flange frame 32, and an intermediate section connection between the upper and lower flange frames. In this embodiment, leads of varying length can be used with the apparatus. At or near the top of the tower are pile lifting means. One embodiment uses a winch 33 on the crawler with a cable passing over pulleys 34 atop the leader 28 and with a hook 35 at the end of the cable. Alternatively, the winch can be mounted to the gantry or to the leads. In operation, the cable is lowered and then hooked onto a pile for lifting.

In this specification, the term pile encompasses a variety of work pieces that can be driven into the ground for construction foundations, soil modification or bulkheading. For example, the term includes sheet, solid or tubular pilings and earth anchors. Also included are sheet piles, for example and without limitation, the type disclosed in U.S. Pat. No. 4,863,315 to Wickberg, and the wick drain members as disclosed in U.S. Pat. No. 4,358,221 to Wicksberg.

The leader 28 contains the driving means, which in the preferred embodiment is a hydraulic cylinder 43 with a ram at the end of telescoping sections of the piston 44. The hydraulic cylinder 43 is mounted within the top of the leader 28, also referred to as the leads. It is aligned so that the ram and piston of the hydraulic cylinder 43 will extend downward within the leads along a center line framed within the guide means described below. The piston 44 has an alignment means that serves to keep it moving straight down the center line. The alignment means in one embodiment is a centering collar 45 attached around a section of the telescoping piston. The outer edges of the centering collar 45 slide along the beams of the leads. In connection with the driving means, the end of the ram can be fitted with a variety of driver pieces 36 having shapes or surfaces adapted to engage the end of the pile to be driven. This receiving means embodied on the ram end of the hydraulic driver is detachable, such as, with a threaded connection.

The pile is raised with the lifting means. The upper end of the pile is raised into contact with the receiving means 36 on the driving means. It engages the pile, using embodiments such as a channel, or a short tube that is greater in circumference than the pile, or opposing angular or parallel surfaces that partially or completely encircle the upper end of the pile. The pile is aligned with the center line defined within the confines of the leader. The lower portion of the pile is brought in contact with the inner guide means 37.

The guide assembly can be an embodiment that includes an inner guide 37 that is opposite an outer guide 38 affixed to a gate on hinges 39 and having closure 42. The inner guide 37 is attached within an aligned parallel with the leader. The inner guide 37 has a surface that is compatible with the side of the pile to be driven. The inner guide can be detachably mounted, so that it can be replaced with a guide having a different surface adapted for a different type of pile. The inner guide can be attached with a pivot 40 or pin at its upper end. The lower end of the inner guide can be moveable, in relation to the upper end, so that it moves horizontally in a hinge fashion. In this embodiment, the lower end has an adjustable connector arm 41, such as a hydraulic cylinder, that connects between the bottom of the inner guide 37 and the crawler vehicle 1. This holds the inner guide, and thus, the pile in proper driving position. The outer guide 38 also has a surface that is compatible with the side of the pile being used, and the outer guide also can be detachably mounted on the gate. Alternatively, the outer guide can have multiple surfaces that accept a variety of pile shapes. In some embodiments, the guide means includes springs or rollers along the guide surfaces to impose some pressure against the side of the pile being driven. Once the pile has been lifted into place, and the top of the pile engaged in the receiving means, and the lower portion of the pile aligned with the guide means, then the gate is shut and latched using suitable means 42 and the pile is ready to be driven.

The pile is driven between the guide means and into the ground. The hydraulic cylinder 43 is pressurized to force the ram downward. As the hydraulic ram presses down on the pile, opposing force is transmitted against the leads 28, down the extension arms 27 and erecting struts 26, and against the gantry 22 and then down to the base positioning means and the member 10 against the ground. The structures and means described above enable the leads to be lowered onto a trailer, transported to a work site and re-erected simply. The erecting struts 26 are extended and the top of the leader 28 is lowered, as the bottom pivots upon the lower flange 30, pin 31 and attachment point 1*a* on the crawler. When fully lowered, the attachment pin 31 is removed. The leader is separated onto a transport vehicle. After the leader has been lowered, the erecting struts are lowered completely and onto the rest positions 24 upon the gantry, previously described and then the struts are retracted. As part of this procedure, the hydraulic pressure and control lines are disconnected. The leader apparatus and the crawler with the attached gantry and positioning means then can be transported. To re-erect the leads 28 for use, the lower end is backed up on its trailer to the front of the crawler. The lower flange 30 on the leader is pinned to the ears 1*a* on the crawler. At the appropriate time, the hydraulic lines are connected. The erecting struts 26 are extended and the ends of the extension arms 27 are pinned to the upper attachment points 32 on the leader. The erecting struts 26 are retracted, and the leader 28 is raised. Alternatively the winch 33 and pulleys 34 that comprise the pile lifting means can erect the leader, or a second winch may be included for this purpose and the operation can utilize the hydraulic driving means to raise the leads.

The crawler 1 with the entire apparatus then is moved on the crawler to the work site. The positioning means press the base member 10 to the ground and it lifts the rear of the crawler. The two hydraulic units 12 of the positioning means are extended more or less to adjust the position of the crawler in relation to the level of the ground at the work site. In this manner, the apparatus can be used on uneven terrain. The struts 26 are extended or retracted to place the leader 28 at the desired driving angle. For example, a pile could be driven perpendicular with the ground level, when on uneven terrain, or a batter pile or an earth anchor could be driven at an acute angle with the ground level.

I claim:

1. A pile driving apparatus for a back hoe or a crawler vehicle having hydraulic pumps and controls, attachment ears, and a rear-mounted counterweight, said apparatus comprising, a base member connected to the rear of said vehicle parallel to said counterweight with means for extending said base member against the ground surface and for retracting said member, a gantry frame with upright members attached to the rear of said vehicle and with compression members that transverse said vehicle and attach near the front of said vehicle and said frame having front and rear attachment ears, a leader pivotally connected at the lower end to said upper attachment point, erecting means that extend and retract attached between said vehicle and said upper attachment point on said leader, a hydraulic driving means comprised of a hydraulic cylinder fixed to and in alignment with said leader and a downward extendable piston, and guide means fixed to and in alignment with said leader and having opposing guide surfaces defining an aperture below said hydraulic driving means.

2. A pile driving apparatus as in claim 1 wherein said means for extending said base member comprise a cross bar attached on the rear of said vehicle and a pair of hydraulic cylinders attached to said cross bar, said cylinders having pistons attached to said base member.

3. A pile driving apparatus as in claim 1 wherein said erecting means comprises a pair of hydraulic cylinders connected to a cross bar mounted on the rear of said vehicle, said cylinders having pistons attached to said upper attachment point on said leader.

4. A pile driving apparatus as in claim 1 wherein said erecting means in a winch and cable.

5. A pile driving apparatus as in claim 1 wherein said hydraulic cylinder is attached to the top of said leader and said piston has telescoping sections with a ram end.

6. A pile driving apparatus as in claim 1 wherein said hydraulic cylinder is attached to the top of said leader and said piston has telescoping sections that have a ram end and one section having a centering collar with outer edges slidably mounted along said leader.

7. A pile driving apparatus as in claim 1 wherein said guide means comprises an inner guide surface attached to said leader and an outer guide surface mounted on a gate closure.

8. A pile driving apparatus as in claim 1 further comprises a lifting means mounted on said vehicle.

* * * * *